US006083596A

United States Patent [19]

Pacione

[11] Patent Number: 6,083,596

[45] Date of Patent: Jul. 4, 2000

[54] HOOKED TAPE WITH ADHESIVE FOR FASTENING CARPET SEAMS

[75] Inventor: Joseph Rocco Pacione, Thornhill, Canada

[73] Assignee: TAC-FAST Georgia, L.L.C., Atlanta, Ga.

[21] Appl. No.: 09/076,906

[22] Filed: May 13, 1998

[51] Int. Cl.[7] ..... A47G 27/04

[52] U.S. Cl. ..... 428/62; 428/61; 428/100; 24/306; 24/442; 156/71; 156/304.3; 156/304.4

[58] Field of Search ..... 428/62, 61, 100; 156/71, 91, 92, 304.3, 304.4; 24/444, 306, 442

[56] References Cited

U.S. PATENT DOCUMENTS

| | | |
|---|---|---|
| 3,391,434 | 7/1968 | Girard . |
| 3,711,349 | 1/1973 | Snyder et al. . |
| 4,557,774 | 12/1985 | Hoopengardner . |
| 4,822,658 | 4/1989 | Pacione . |
| 5,060,443 | 10/1991 | Pacione . |
| 5,133,166 | 7/1992 | Pacione . |
| 5,191,692 | 3/1993 | Pacione . |
| 5,382,462 | 1/1995 | Pacione . |
| 5,479,755 | 1/1996 | Pacione . |
| 5,654,066 | 8/1997 | Pacione . |
| 5,723,195 | 3/1998 | Pacione . |

FOREIGN PATENT DOCUMENTS

| | | |
|---|---|---|
| 0062738 | 10/1982 | European Pat. Off. . |
| 2201231 | 7/1973 | Germany . |
| 59-81479 | 6/1984 | Japan . |
| 0267519 | 8/1970 | Russian Federation . |
| 1204886 | 9/1970 | United Kingdom . |
| 1546901 | 5/1979 | United Kingdom . |
| 86/01247 | 2/1986 | WIPO . |
| 94/00043 | 1/1994 | WIPO . |
| 98/03104 | 1/1998 | WIPO . |

*Primary Examiner*—Alexander Thomas
*Attorney, Agent, or Firm*—Blake, Cassels & Graydon LLP

[57] ABSTRACT

Carpet tape for use with a carpet construction which uses a loop back and hook tape for installation. The tape includes a substrate having pressure sensitive adhesive on one of its surfaces and there are hooked areas on the same surface. The hooked areas are located on either side of the pressure sensitive adhesive for engagement of the loops of pieces of the carpet. The adhesive is located on an area of the substrate substantially free of hooks, and the hooked areas are spaced apart from each other, for adhesion to the underside of the carpet pieces along neighboring edges for formation of a seam between the carpet pieces.

38 Claims, 3 Drawing Sheets

HOOKED TAPE WITH ADHESIVE FOR FASTENING CARPET SEAMS

FIELD OF THE INVENTION

This invention relates to carpet tape to be used with a carpet construction which uses a loop back and hook tape for installation.

BACKGROUND OF THE INVENTION

In U.S. Pat. No. 4,822,658 entitled "Carpet Backing and Installation System" issued Apr. 18, 1989, the same inventor disclosed a new carpet backing and installation system. This new carpet with its backing has proved to be commercially successful. Installation of carpet using tape as described with this system saves considerable time and energy. Further, once the tape has been installed, worn or damaged carpet can be easily replaced by removal of the carpet and by the installation of new carpet over the installed tape. The tape, once installed can be reused many times, and it is at this stage that significant economies can be achieved.

In U.S. Pat. No. 4,822,658 a tape is disclosed having hooks and a covering over the hooks to prevent premature attachment of the hooks onto loops contained on the underside of carpet backing. On the opposite, bottom side of the tape is a pressure sensitive adhesive for adhering the tape to the floor. A release paper is attached over the adhesive at the back of the tape to be removed prior to installation of the tape on the floor. It is suggested that a protective strippable cover on the hooks be attached to an exposed hookless area by contact adhesive along one or both edges of the upper face to prevent, during installation, premature attachment of the hooks to the loops covering the back area of the carpet. Other means for attaching a hook covering to the hooked tape for the purposes of preventing premature attachment of carpet loops to the hooks are described in U.S. Pat. No. 5,191,692, the specification of which is incorporated herein by reference.

In practice, the most common hook covering currently employed is a loosely knit cloth which loosely engages the hooks of the tape and which is readily dislodged therefrom when the carpet has been located in place for its loops to be secured to the hooks of the tape. A currently available tape and covering is available through TAC-FAST Georgia, L.L.C. of Atlanta, Ga.

Engagement of the loops and hooks of the carpet and tape along carpet seams has sometimes been found to be less than perfect, particularly in terms of the appearance of the seam. Sometimes, a carpet piece is imperfectly manufactured and has a tendency to curl up along its edge in a manner which, however slight, is visible and unsightly. The strength of engagement between currently used carpet loops and tape hooks appears to be inadequate to address this problem.

SUMMARY OF THE INVENTION

In a first broad aspect, the present invention is a tape for securing neighboring edges of first and second pieces of web material, for example a carpet, to a structural surface such as a floor, the web material having loops on its underside. The tape includes:

- a substrate having pressure sensitive adhesive on a first surface thereof; and
- first and second hooked areas, on the first surface, on either side of the pressure sensitive adhesive for engagement of the loops of the first and second pieces, respectively.

The adhesive is located on an area of the substrate substantially free of hooks, and the first and second hooked areas are spaced apart from each other, for adhesion to the undersides of the pieces along said neighboring edges thereof for formation of a seam therebetween.

Substantially free of hooks means that there are no hooks in the area of the adhesive or there are sufficiently few hooks in the area of the adhesive so as to permit the substrate adhesive and the undersides of the pieces to adhere to each other.

In use for fastening carpet to a floor, the tape is secured to the floor below a carpet seam such that the adjacent edges of the carpet pieces lie above the central adhesive portion of the tape. In this way, carpet edges forming the seam are adhered to the tape and the hooks of the tape engage the loops on the underside of the carpet in the region immediately adjacent the seamed edges.

In a preferred embodiment, the tape includes pressure sensitive adhesive on a second surface of the substrate, for adhesion of the tape to the structural surface. Preferably, there is a release paper secured to the pressure sensitive adhesive on the second surface of the substrate. The paper protects the adhesive prior to installation of the tape on the surface.

Preferably, the substrate has a linear neutral axis and more preferably the substrate is of substantially constant cross section.

In a particular embodiment, each of the first and second hooked areas is a row of hooks.

Preferably, the tape also includes a release paper secured to the adhesive on the first surface. The release paper protects the adhesive prior to use and the paper is removed for adhesion to the web material to be secured thereby. Other suitable web material can be used in place of paper. The release paper is dimensioned to cover the adhesive on the first surface. The paper may be large enough to extend over the hooked areas so as to preclude premature attachment thereto by the loops of the first and second pieces of the web material during installation thereof. Preferably, the release paper includes a visual indicator, e.g., a line marked thereon, located to be coincident with the seam to assist in locating the first and second pieces during installation.

In another embodiment, there is a releasable cover for engagement of the first and second hooked areas so as to preclude premature attachment thereto by the loops of the first and second pieces of the web material during installation thereof. In this case, the release paper is dimensioned to substantially cover the adhesive on the first surface of the substrate so as to preclude premature adhesion thereto by the undersides of the first and second pieces of the web material during installation thereof, but does not extend to cover the hooked areas so as to permit the engagement of the releasable cover and the first and second hooked areas.

There may be first and second releasable covers which engage the first and second hooked areas, respectively, so as to preclude premature engagement thereof by the loops of the first and second pieces of the web material during installation.

Such releasable covers can be cloth.

Typically, but not restrictively, the substrate is between about ½ and 3 inches in width.

In a particular embodiment, the invention is a tape for securing abutting edges of first and second pieces of carpet to a floor, each of the carpet pieces having loops of a hook and loop fastening systems on its underside, the tape comprising:

- a flexible longitudinal substrate having pressure sensitive adhesive on an upper first surface thereof; and first and second rows of upstanding hooks of the hook and loop fastening system on the first surface of the substrate on either side of the pressure sensitive adhesive for engagement of the loops of the first and second carpet pieces, respectively, when the tape is secured to the floor; and wherein, the adhesive is located on a central area the first surface substantially free of hooks and the first and second rows of hooks are spaced sufficiently from each other to permit adhesion of the undersides of the first and second pieces to the substrate by the adhesive along said abutting edges thereof for formation of a seam therebetween.

In another aspect, the invention is a method of forming a seam between abutting pieces of looped-backed flexible sheet material and securing the pieces to a surface to be covered by the sheet material. The method includes:

(i) adhering a first tape having pressure sensitive adhesive on an obverse side thereof to first and second backsides of neighboring edges of first and second pieces of the sheet material, (ii) securing the first tape to the surface;

(iii) locating first and second hooked tapes along first and second lengthwise edges of the first tape;

(iv) engaging hooks of the first and second hooked tapes, respectively, with loops on the backsides of the first and second pieces of the sheet material; and (v) securing the first and second hooked tapes to the surface.

Preferably, steps (ii) and (v) precede steps (i) and (iv).

Preferably, such a method includes use of a first tape having a release paper and first and second hooked tapes having first and second releasable covers. Step (i) thus includes locating the neighboring edges of the abutting pieces to abut each other along a line located centrally of the first tape, and including the subsequent steps of rolling back the first piece to expose the first releasable cover, removing the first releasable cover to expose hooks of the first hooked tape and securing the first piece to the first hooked tape by engagement of the hooks of the tape with said loops on the backside of the piece, rolling back the second piece to expose the second releasable cover, removing the second releasable cover to expose hooks of the second hooked tape and securing the second piece to the second hooked tape by engagement of the hooks of the tape with said loops on the backside of the piece.

Preferably, the first and second releasable covers comprise a web material which spans the width the first tape and first and second hooked tapes when secured to the surface.

Preferably, each of the first tape and the first and second hooked tapes are secured to the surface by pressure sensitive adhesive.

The invention also includes a method of forming a seam between abutting pieces of looped-backed flexible sheet material and securing the pieces to a surface to be covered by the sheet material in which the any of hooked tapes bearing adhesive, described above are used. The method thus includes securing the tape to first and second backsides of neighboring edges of first and second pieces of the sheet material by adhesion of the backsides to the pressure sensitive adhesive and by engagement of the first and second hooked areas with the first and second backsides, respectively, and securing the tape to the surface; and locating first and second hooked tapes along first and second lengthwise edges of the first tape and engaging hooks of the first and second hooked tapes, respectively, with loops on the backsides of the first and second pieces of the sheet material, and securing the first and second hooked tapes to the surface.

The method preferably includes securing the tape to the surface by adhering the tape to the surface by pressure sensitive adhesive on a second surface of the substrate. Typically, the tape includes a release paper secured to the pressure sensitive adhesive on the second surface of the substrate and the method thus includes removing the release paper prior to securing the tape to the surface.

Preferably, the method includes use of tape in which the substrate has a linear neutral axis. Particularly, the substrate is of substantially constant cross section.

Preferably, the invention includes securing to the surface a tape in which each of the first and second hooked areas is a row of hooks.

A preferred tape has a release paper secured to the adhesive on the first surface and use thereof includes locating the tape and securing the tape in place prior to removal of the paper. This permits locating the pieces in place with respect to the tape so as to preclude premature attachment thereto by the loops of the first and second pieces of the web material during installation thereof.

The method can include use of a tape having a release paper that includes a visual indicator located to be coincident with a the seam to be formed. Such a preferred method thus includes aligning the indicator and edges of neighboring pieces to be in abutment with each other prior to removal of the release paper from the tape.

The tape can further include a releasable cover for engagement of the first and second hooked areas so as to preclude premature attachment thereto by the loops of the first and second pieces of the web material during installation thereof. In such an instance, the release paper is dimensioned to substantially cover the adhesive on the first surface of the substrate so as to preclude premature adhesion thereto by the undersides of the first and second pieces of the web material during installation thereof, and to permit the engagement of the releasable cover and the first and second hooked areas.

Alternatively, the tape can include first and second releasable covers which engage the first and second hooked areas, respectively, so as to preclude premature engagement thereof by the loops of the first and second pieces of the web material during installation thereof, and wherein the release paper is dimensioned to substantially cover the adhesive on the first surface of the substrate so as to preclude premature adhesion thereto by the undersides of the first and second pieces of the web material during installation thereof, and to permit the engagement of the releasable covers and the first and second hooked areas.

The invention also includes an installation of looped-backed flexible sheet material, such as a carpet, in which the sheet material is secured to a surface, e.g. a floor. The installation includes:

first and second pieces of said sheet material having abutting edges;

a tape secured to a surface underlying the pieces, located below the abutting edges and bearing pressure sensitive adhesive on an obverse face, adhered to undersides of the first and second pieces to secure the edges thereof to said surface; and first and second hooked tapes secured to the surface along first and second lengthwise edges of the tape bearing pressure sensitive adhesive, hooks of the first and second hooked tapes being in engagement with loops of first and second of pieces, respectively.

The invention also includes a method of manufacturing a hooked tape, comprising:

providing a flexible longitudinal tape-like substrate;

providing the substrate with hooks of a hook and loop fastening system on a first side of the substrate, there being first and second areas of the hooks on either side of a central area of the substrate, the central area being substantially free of hooks; and providing the central area with pressure sensitive adhesive.

Preferably, the method includes the further step of providing the central area with a release paper for protecting the adhesive prior to installation of the tape.

The method can also include the step of providing a second side of the substrate with pressure sensitive adhesive, for installing the tape to a flat surface such as a floor or wall.

The method can include the step of providing the adhesive of the second side of the substrate with a release paper for protecting the adhesive prior to installation of the tape.

The method can also include the step of providing the substrate with hooks comprises providing the substrate with first and second rows of hooks, one on either side of a center line of the substrate running through the central area of the substrate.

The substrate can be extruded plastic.

Other embodiments of the invention are described and claimed below.

BRIEF DESCRIPTION OF THE DRAWINGS

Embodiments of the invention will now be described by way of example with reference to the drawings, in which.

PREFERRED EMBODIMENTS

Figure 1:
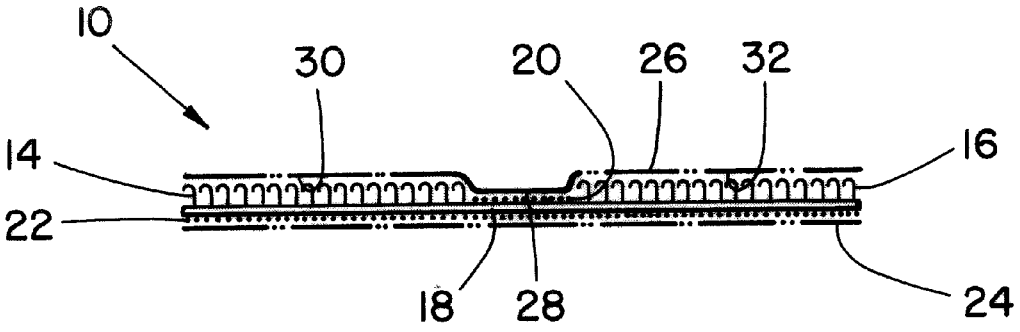
FIG. 1 shows a cross-sectional view of a first embodiment of the invention which includes a tape and a single piece covering for the adhesive and hooks of the tape.

Turning to the drawings, a first embodiment tape 10 is illustrated in FIG. 1. Tape 10 includes longitudinal substrate 12 having rows of upstanding hooks 14, 16 running lengthwise along its edges. Rows 14, 16 are spaced from each other to provide a central area 18 therebetween, this central area being free of hooks and having pressure sensitive adhesive 20 applied thereto. Tape 10 also includes pressure sensitive adhesive 22 applied across essentially its entire underside and conventional release paper 24 to protect adhesive 22 prior to use.

As shown in FIG. 1, the top side (obverse side), of tape 10 is provided with covering 26 for pressure sensitive adhesive 20 and hooks 14, 16. Covering 26 is illustrated as a paper covering having the central portion 28 treated with conventional release material so that it can be removed from the tape, leaving the adhesive behind atop the substrate. It is not necessary to treat the underside of areas 30, 32 which cover the hooks. Cover 26 thus provides two functions: it protects adhesive 20 until the tape is to be used; and it covers the adhesive and the hooks to preclude premature attachment thereto by a carpet during installation of the carpet.

In use, tape 10 is installed in much the same way as the tape described in U.S. Pat. No. 4,822,658, the specification of which is incorporated herein by reference, is installed. Generally, however, the tape of the present invention is installed only where holding power superior to that provided by normally used hooked tape is or might be insufficient. This might be along seams located in areas of particularly high use, or as described above, where it is found that the carpet being installed is prone to curling at its seamed edges.

Figure 4:
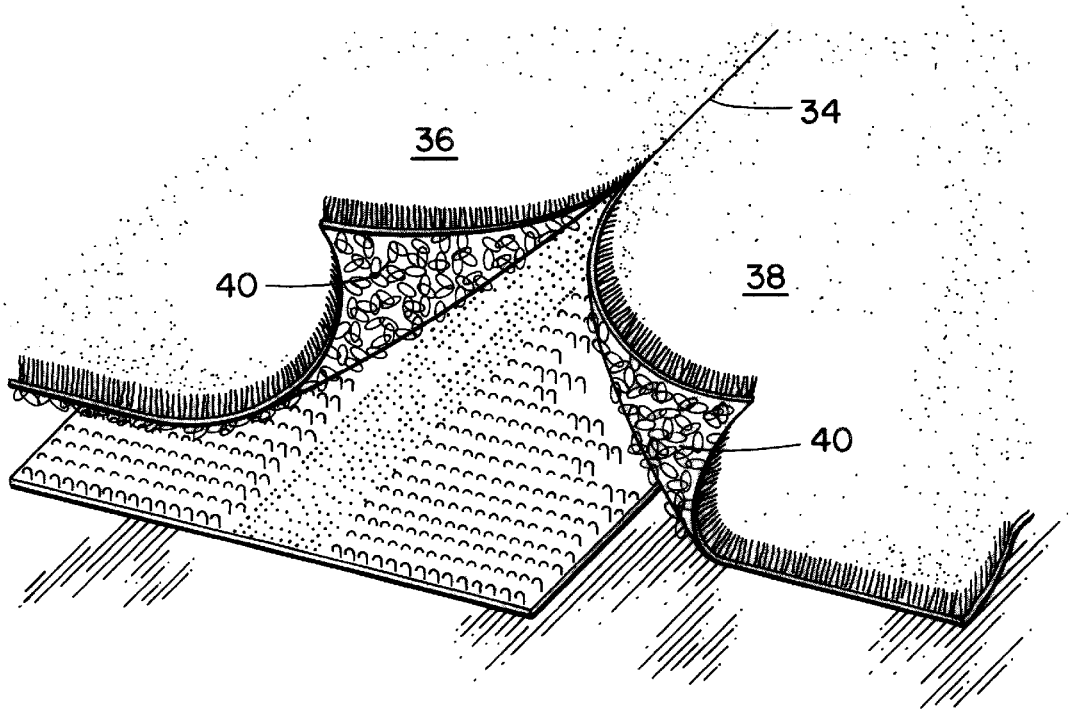
FIG. 4 shows the tape of FIG. 1 assembled with a carpet.

Thus, tape 10, still bearing cover 26 is secured to a flooring surface by adhesive 22 after removal of release paper 24. The tape is located on the floor, as much as reasonably possible, with the center line 25 of the tape coincident with the location of the seam 34 to be formed between two abutting edges of carpet pieces 36, 38. For location purposes, it can be advantageous for the center line of the tape to be indicated on covering 26. Once the tape is adhered to the floor and carpet pieces with abutting edges correctly located thereabove, as in FIG. 4, the abutting edges are rolled back away from the tape, cover 26 removed and the edges rolled back into place and pressed downwardly upon to bring loops 40 on the underside of the carpet pieces into engagement with hooks 14, 16 and adhesive 20 on the top side of the tape.

Figure 2:
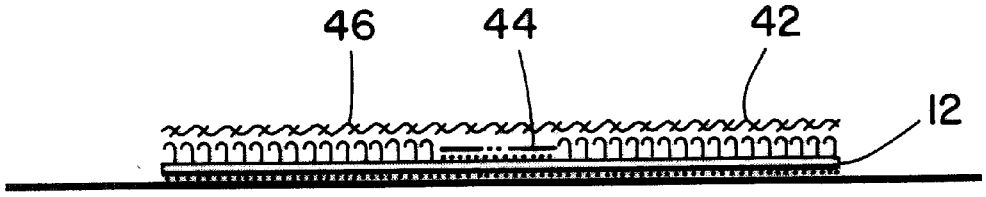
FIG. 2 shows the tape of FIG. 1, installed on a floor surface, having a release layer for the adhesive and a separate covering for the hooks.

Turning to FIG. 2, a second type of tape covering 42 is illustrated in connection with tape 10. Covering 42 is made up of two parts. Central part 44 is a conventional type of release paper which covers pressure sensitive adhesive 20, and overlying part 46, which is made of a loosely knit synthetic fabric much the same as those in current commercial use with hooked carpet tapes. The installations resulting from the use of the tape and covers illustrated in FIG. 2 are the same. See FIG. 4. The method of installing the carpet and tape having cover 42 differs somewhat from that having cover 26. The steps of locating the tape bearing the cover and the carpet, and installing the tape to the floor surface are the same. After the abutting carpet edges are rolled back from the tape, overlying part 46 of the cover is removed from the tape and the edges moved back into place. At this point, because only hooks 14, 16 are exposed, central cover part 44 remaining in place over adhesive 20, the only type of fastening connection between the carpet and tape is due to the engagement hooks of the tape and loops of the carpet. Because this engagement is entirely reversible, it is possible to finely adjust the abutting edges defining the seam between carpet pieces. Once this is completed, central cover part 44 is drawn up through the seam while keeping the hook-loop engagement intact. After part 44 is removed, the edges of the carpet are pressed into place with adhesive 18 to complete the installation of the seamed area.

Figure 3:
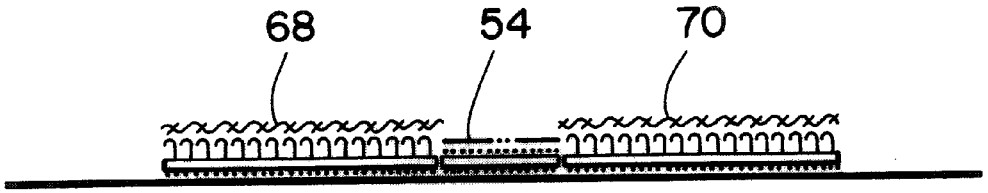
FIG. 3 shows an adhesive strip installed on a floor between a pair of separate hooked tapes according to the invention.
Figure 5:
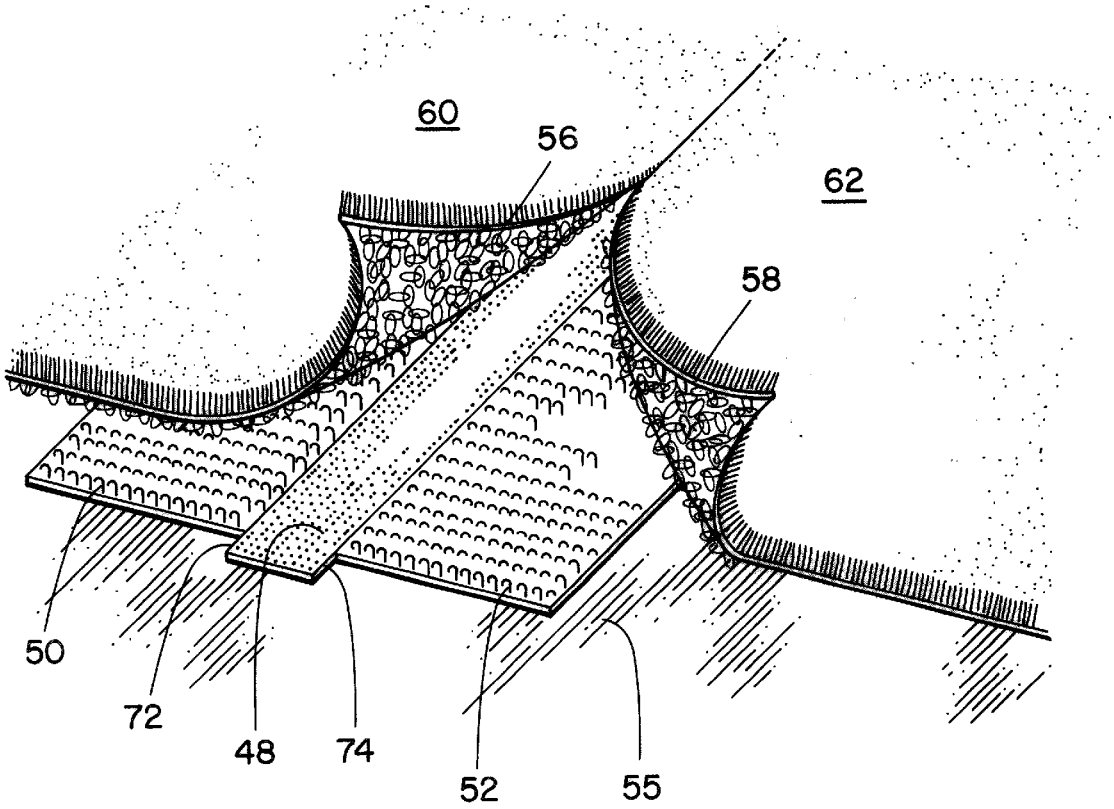
FIG. 5 shows the adhesive strip and hooked tapes of FIG. 3 assembled with a carpet.

Another embodiment of the invention involves installing separate adhesive tape 48 and hooked tapes 50, 52, shown in FIG. 3, as part of the carpet installation illustrated in FIG. 5. In this embodiment, double-sided adhesive tape 48, with conventional type release paper 54 intact, is adhered to a floor surface 55 so as to be centered along a seam to be formed between two abutting edges 56, 58 of neighboring carpet pieces 60, 62. Hooked tapes 50, 52 with coverings 68, 70 intact are adhered to the floor surface in locations along side lengthwise edges 72, 74 of the adhesive tape. This arrangement is functionally similar to the arrangement obtained with tape 10 and coverings 44, 46 described above in connection with FIG. 2.

Likewise, the method of installing carpet pieces 60, 62 with tapes 48, 50, 52 is similar to installing carpet pieces with tape 10 and coverings 44, 46, at least once tapes 48, 50, 52 have been installed to a floor surface. In this case, however, after the abutting carpet pieces are rolled back from above the tapes, tape hook coverings 68, 70 are removed individually, rather than in the single step involved with cover 46. It might be found advantageous, under particular circumstances, to provide the FIG. 2 embodiment of tape 10 with separate hook coverings in analogy to coverings 68, 70, rather than with a single overlying covering. A covering for the adhesive on the top side of the substrate can also be provided with a visual indicator, such as that provided by line 71 marked onto release paper 54. The indicator can be used to both locate the tape on the floor and to locate a carpet with respect to the tape.

All of the tapes of the preferred embodiments are of constant cross section, as can be seen most readily in FIGS. 1 to 3.

The final installation obtained using the tape components illustrated in FIG. 3 is illustrated in FIG. 5.

As far as the hook and loop attachment portions of the present invention are concerned, these by themselves are known in the art and are similar to those sold under name Velcro™. The width of the hooked portion of a tape is typically between ½ and 3 inches, but this can vary depending upon requirements. It is well within the ability of a person skilled in the art to obtain a suitable width for a particular application.

As far as the pressure sensitive adhesive used to adhere to the underside of neighboring carpet pieces at the seam is concerned conventional adhesives can be used, and here again, it within the capacity of a person skilled in the art to provide a pressure sensitive adhesive with sufficient holding power to meet particular requirements.

Besides the carpet described in U.S. Pat. No. 4,822,658, the carpet described in international patent application No. PCT/CA 93/00275 (published under WO 94/00043 on Jan. 6, 1994) is also suitable for use in connection with the invention described herein. The specification of this document is incorporated herein by reference.

Although the detailed examples provided here described securing abutting edges of "free floating" carpets through use of the present invention, it is equally well possible to secure seams between carpets in which more than perimeter portions of the carpet pieces are secured to the floor surface.

It will be appreciated that the present invention, while incorporating the use of adhesive at seamed carpet edges, retains advantages of hook and loop fastening technology. Particular advantages of hook and loop technology include the ability to reuse installed hooked tapes when replacing worn carpets and the ability to adjust the location of abutting edges during carpet installation.

It will be appreciated, for example, that tape 10 can be reused by installation of a separate double sided adhesive tape to replace adhesive 20, if the holding power of the adhesive becomes diminished over time, say after several adjustments, or because of exposure to dirt, air or the elements in general, etc. It is also possible to "refresh" adhesive 20 with a new coating of adhesive which is applied in a solvent and allowed to dry.

The superiority of seams obtained between neighboring carpet pieces through use of the present invention appears to stem from the combination of two types of engagement between the carpet and the underlying tape. The hook and loop engagement provides a fastening engagement in which the carpet as a whole is secured in place, particularly against lateral (horizontal) slippage away from a carpet seam. Hook and loop engagement forces are relatively unaffected by temperature changes, for example, and can tolerate exposure to minor amounts of dirt, liquid, etc. Adhesive forces provided by pressure sensitive adhesive, however, are less reliable in this regard, but on the other hand can provide superior vertical adhesion forces provided lateral strain is removed in use or at least substantially reduced, as is the case in the present invention, where the hook and loop engagement largely secures the carpet pieces against lateral slippage. Further, it is possible to "adjust" the adhesive force by use of more powerful adhesive applied to a particular tape without making an adjustment to the carpet, as, say by, increasing the density of loops.

It is now possible, through the present invention, to obtain advantages of pressure sensitive adhesive in localized areas of seams, where they are particularly desirable, while retaining the advantages of hook and loop technology in securing the carpet generally and at the room perimeter where hook and loop technology appears to remain adequate.

Preferred embodiments of the invention having been described, the scope of protection sought for the invention is defined by the claims which follow.

What is claimed is:

1. A tape for securing neighboring edges of first and second pieces of web material to a structural surface such as a floor, the web material having loops on its underside, the tape comprising:

a substrate having pressure sensitive adhesive on a first surface thereof; and first and second hooked areas, on the first surface, on either side of the pressure sensitive adhesive for engagement of the loops of the first and second pieces, respectively, wherein:

the adhesive is located on an area of the substrate substantially free of hooks, and the first and second hooked areas are spaced apart from each other, for adhesion to the underside of the pieces along said neighboring edges thereof for formation of a seam therebetween.

2. The tape of claim 1, further comprising pressure sensitive adhesive on a second surface of the substrate, for adhesion of the tape to the structural surface.

3. The tape of claim 2, further comprising a release paper secured to the pressure sensitive adhesive on the second surface of the substrate.

4. The tape of claim 1, wherein the substrate has a linear neutral axis.

5. The tape of claim 4, wherein the substrate is of substantially constant cross section.

6. The tape of claim 1, wherein each of the first and second hooked areas comprises a row of hooks.

7. The tape of claim 1, further comprising a release paper secured to the adhesive on the first surface.

8. The tape of claim 7, wherein the release paper is dimensioned to cover the adhesive on the first surface and the hooked areas so as to preclude premature attachment thereto by the loops of the first and second pieces of the web material during installation thereof.

9. The tape of claim 7, wherein the release paper includes a visual indicator located to be coincident with a said seam to assist in locating the first and second pieces during installation thereof.

10. The tape of claim 7, further comprising a releasable cover for engagement of the first and second hooked areas so as to preclude premature attachment thereto by the loops of the first and second pieces of the web material during installation thereof, and wherein the release paper is dimensioned to substantially cover the adhesive on the first surface of the substrate so as to preclude premature adhesion thereto by the undersides of the first and second pieces of the web material during installation thereof, and to permit the engagement of the releasable cover and the first and second hooked areas.

11. The tape of claim 7, further comprising first and second releasable covers which engage the first and second hooked areas, respectively, so as to preclude premature engagement thereof by the loops of the first and second pieces of the web material during installation thereof, and wherein the release paper is dimensioned to substantially cover the adhesive on the first surface of the substrate so as to preclude premature adhesion thereto by the undersides of the first and second pieces of the web material during installation thereof, and to permit the engagement of the releasable covers and the first and second hooked areas.

12. The tape of claim 11 wherein the substrate is between about ½ and about 3 inches in width.

13. The tape of claim 1 wherein the substrate is between about ½ and 3 inches in width.

14. A method of forming a seam between abutting pieces of looped-backed flexible sheet material and securing the pieces to a surface to be covered by the sheet material, the method comprising:

securing a tape of claim 1 to first and second backsides of neighboring edges of first and second pieces of the sheet material by adhesion of the backsides to the pressure sensitive adhesive and by engagement of the first and second hooked areas with the first and second backsides, respectively, and securing the tape to the surface; and locating first and second hooked tapes along first and second lengthwise edges of the first tape and engaging hooks of the first and second hooked tapes, respectively, with loops on the backsides of the first and second pieces of the sheet material, and securing the first and second hooked tapes to the surface.

15. A tape for securing abutting edges of first and second pieces of carpet to a floor, each of the carpet pieces having loops of a hook and loop fastening systems on its underside, the tape comprising:

a flexible longitudinal substrate having pressure sensitive adhesive on an upper first surface thereof; and first and second rows of upstanding hooks of the hook and loop fastening system on the first surface of the substrate on either side of the pressure sensitive adhesive for engagement of the loops of the first and second carpet pieces, respectively, when the tape is secured to the floor; and wherein, the adhesive is located on a central area the first surface substantially free of hooks and the first and second rows of hooks are spaced sufficiently from each other to permit adhesion of the undersides of the first and second pieces to the substrate by the adhesive along said abutting edges thereof for formation of a seam therebetween.

16. The tape of claim 15, further comprising pressure sensitive adhesive on a lower second surface of the substrate.

17. The tape of claim 16, further comprising a release paper secured to the pressure sensitive adhesive on the second surface.

18. The tape of claim 15, wherein the tape is of substantially constant cross section.

19. The tape of claim 15, further comprising a release paper secured to the adhesive on the first surface.

20. The tape of claim 19, wherein the release paper is dimensioned to cover the adhesive on the first surface and the first and second rows of hooks to preclude premature attachment thereto by the loops of the first and second pieces of the carpet material during installation thereof.

21. The tape of claim 19, wherein the release paper includes a visual indicator located to be coincident with a said seam to assist in locating the first and second pieces during installation thereof.

22. The tape of claim 19, further comprising a releasable cover which overlays the release paper and engages the first and second rows of hooks so as to preclude premature engagement thereof the loops of the first and second pieces of the carpet during installation thereof, and wherein the release paper is dimensioned to substantially cover the adhesive on the first surface of the substrate so as to preclude premature adhesion thereto by the undersides of the first and second pieces of the carpet during installation thereof, and to permit the engagement of the releasable cover and the first and second rows of hooks.

23. The tape of claim 22 wherein the releasable cover comprises cloth.

24. The tape of claim 19, further comprising first and second releasable covers which engage the first and second rows of hooks, respectively, so as to preclude premature engagement thereof by the loops of the first and second pieces of the carpet during installation thereof, and wherein the release paper is dimensioned to substantially cover the adhesive on the first surface of the substrate so as to preclude premature adhesion thereto by the undersides of the first and second pieces of the carpet during installation thereof, and to permit the engagement of the releasable covers and the respective first and second rows of hooks.

25. A method of forming a seam between abutting pieces of looped-backed flexible sheet material and securing the pieces to a surface to be covered by the sheet material, the method comprising:

(i) adhering a first tape having pressure sensitive adhesive on an obverse side thereof to first and second backsides of neighboring edges of first and second pieces of the sheet material, (ii) securing the first tape to the surface;

(iii) locating first and second hooked tapes along first and second lengthwise edges of the first tape;

(iv) engaging hooks of the first and second hooked tapes, respectively, with loops on the backsides of the first and second pieces of the sheet material; and (v) securing the first and second hooked tapes to the surface.

26. The method of claim 25, wherein steps (ii) and (v) precede steps (i) and (iv).

27. The method of claim 26, wherein the first tape includes a release paper and the first and second hooked tapes include first and second releasable covers, and step (i) includes locating the neighboring edges of the abutting pieces to abut each other along a line located centrally of the first tape, and including the subsequent steps of rolling back the first piece to expose the first releasable cover, removing the first releasable cover to expose hooks of the first hooked tape and securing the first piece to the first hooked tape by engagement of the hooks of the tape with said loops on the backside of the piece, rolling back the second piece to expose the second releasable cover, removing the second releasable cover to expose hooks of the second hooked tape and securing the second piece to the second hooked tape by engagement of the hooks of the tape with said loops on the backside of the piece.

28. The method of claim 27 wherein the first and second releasable covers comprise a web material which spans the width the first tape and first and second hooked tapes when secured to the surface.

29. The method of claim 25 wherein each of the first tape and the first and second hooked tapes are secured to the surface by pressure sensitive adhesive.

30. The method of claim 25 wherein the surface is a floor and the sheet material is carpet.

31. An installation of looped-backed flexible sheet material, comprising:

first and second pieces of said sheet material having abutting edges;

a tape secured to a surface underlying the pieces, located below the abutting edges and bearing pressure sensitive adhesive on an obverse face, adhered to undersides of the first and second pieces to secure the edges thereof to said surface; and first and second hooked tapes secured to the surface along first and second lengthwise edges of the tape bearing pressure sensitive adhesive, hooks of the first and second hooked tapes being in engagement with loops of first and second of pieces, respectively.

32. The installation of claim 31 wherein the sheet material is carpet and the surface is a surface of a floor.

33. A method of manufacturing a hooked tape, comprising:

providing a flexible longitudinal tape-like substrate;

providing the substrate with hooks of a hook and loop fastening system on a first side of the substrate, there being first and second areas of the hooks on either side of a central area of the substrate, the central area being substantially free of hooks; and providing the central area with pressure sensitive adhesive.

34. The method of claim 33, further comprising the step of providing the central area with a release paper for protecting the adhesive prior to installation of the tape.

35. The method of claim 33, further comprising the step of providing a second side of the substrate with pressure sensitive adhesive, for installing the tape to a flat surface such as a floor or wall.

36. The method of claim 35, further comprising the step of providing the adhesive of the second side of the substrate with a release paper for protecting the adhesive prior to installation of the tape.

37. The method of claim 33, wherein the step of providing the substrate with hooks comprises providing the substrate with first and second rows of hooks, one on either side of a center line of the substrate running through the central area of the substrate.

38. The method of claim 33, wherein the substrate is extruded plastic.

* * * * *